US005238227A

United States Patent [19]

White

[11] Patent Number: 5,238,227

[45] Date of Patent: Aug. 24, 1993

[54] WINDLASS, DRUM WINCH

[76] Inventor: Jack V. White, P.O. Box 5862, Chula Vista, Calif. 91912

[21] Appl. No.: 902,543

[22] Filed: Jun. 22, 1992

Related U.S. Application Data

[63] Continuation of Ser. No. 653,111, Feb. 11, 1991, abandoned.

[51] Int. Cl.[5] ..... B66D 1/36; B66D 1/30

[52] U.S. Cl. ..... 254/372; 254/334; 254/371; 474/96

[58] Field of Search ..... 254/370, 371, 372, 334, 254/382; 474/96; 411/337, 999

[56] References Cited

U.S. PATENT DOCUMENTS

| | | | |
|---|---|---|---|
| 34,834 | 4/1862 | Jackson | 254/372 X |
| 231,071 | 8/1880 | McKay | 474/96 |
| 531,216 | 12/1894 | Patten | 474/96 |
| 2,828,854 | 4/1958 | Cibula | 474/96 X |
| 3,120,043 | 2/1964 | Henley | 254/371 X |
| 3,386,760 | 6/1983 | Hutton | 254/371 |
| 3,792,622 | 2/1974 | Lyall | 226/76 |
| 4,023,775 | 5/1977 | Beattie | 254/372 X |
| 4,151,980 | 5/1979 | Burton et al. | 254/371 |
| 4,453,701 | 6/1984 | Nuggett | 254/371 |
| 4,466,598 | 8/1984 | Eggleton et al. | 254/372 X |
| 4,513,681 | 4/1985 | Crook | 254/372 X |
| 4,722,292 | 2/1988 | Foster et al. | 254/285 X |
| 4,934,888 | 6/1990 | Corsmeier et al. | 411/999 X |

FOREIGN PATENT DOCUMENTS

| | | | |
|---|---|---|---|
| 2645519 | 10/1990 | France | 254/371 |

*Primary Examiner*—Daniel P. Stodola
*Assistant Examiner*—William Stryjewski
*Attorney, Agent, or Firm*—Frank D. Gilliam

[57] ABSTRACT

A clamp on combination chain and rope hauler wheel formed from two semi-circles half wheels having an outer periphery adaptable for gripping the links of a chain and a rope which are removably clamp together and gripping clamp around a drum. The gripping connection to the drum is adjustable to grip a range of different drum diameters of a drum winch.

8 Claims, 4 Drawing Sheets

WINDLASS, DRUM WINCH

This application is a continuation of application Ser. No. 07/653,111, filed Feb. 11, 1991, now abandoned.

BACKGROUND OF THE INVENTION

1. Field of the Invention

This invention relates to a hauling device for attachment to a drum of a drum winch for rope and/or chain. More specifically, this invention relates to an adapter for the drum of a drum winch that clamps to the drum of a winch used aboard boats to haul rope and/or chain of a boats anchor tackle.

2. Prior Art

Drum winches are generally standard equipment aboard sailboats having a length above 20 feet as well as powerboats. Drum winches are used for the handling of ropes such as sheets and halyards and anchor line. Anchor line is typically made up of a rope/chain combination or all chain.

A drum winch is designed to haul rope rather than chain. No device is known, however that clamps onto the drum of a drum winch having a range of diameters that makes it possible to haul a rope/chain combination or an all chain anchor line. The drum winch adapter of this invention can be clamped on to a winch drum when needed and unclamped from a winch drum and stored when not in use. The known devices in this field are a rope and chain hauling device described in U.S. Pat. No. 3,792,622 and a self-tailing winch described in U.S. Pat. No. 4,386,760.

SUMMARY OF THE INVENTION

Manual and electrical anchor windlasses are available designed and dedicated for the specific purpose of hauling rope/chain anchor line.

The principal objective of the present invention is to provide an inexpensive device that clamps onto an existing drum of a drum winch making the drum winch capable of hauling both rope and chain.

Another objective is to provide such a device in two semi-circle halves for quick and easy assembling on a drum of a drum which for use and disassembly therefrom for storage.

A further objective is to provide such a device which can be sized to accommodate different size drums of drum winches. The foregoing objectives can be accomplished by two semi-circle halves of a wheel formed by hub portions that have semi-circular central openings that when the hub portions are secured together they surround and grip the drum of the drum winch forming a wheel therearound having a wall extending radially from each end of the hub portion to form a peripheral channel therebetween, the walls having inwardly projecting opposed portions peripherally spaced on the walls, the projecting opposed portions adapted to engage the rope in wedge grooves formed thereby and chain link engaging pockets around the outer periphery of the wheel for capturing links of a chain therein.

DETAILED DESCRIPTION OF THE PREFERRED EMBODIMENT

Figure 1:
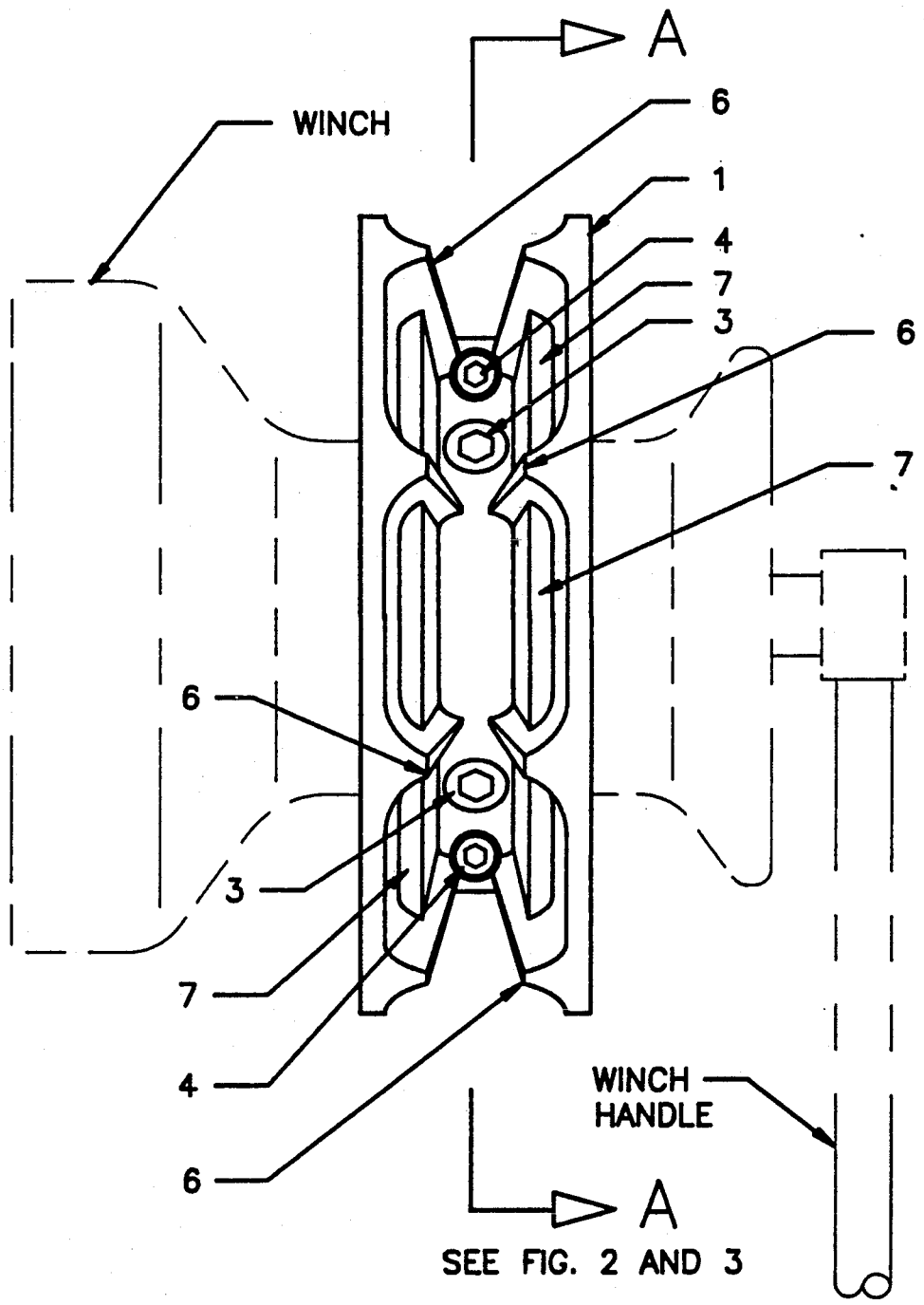
FIG. 1 is a front view of the device
Figure 2:
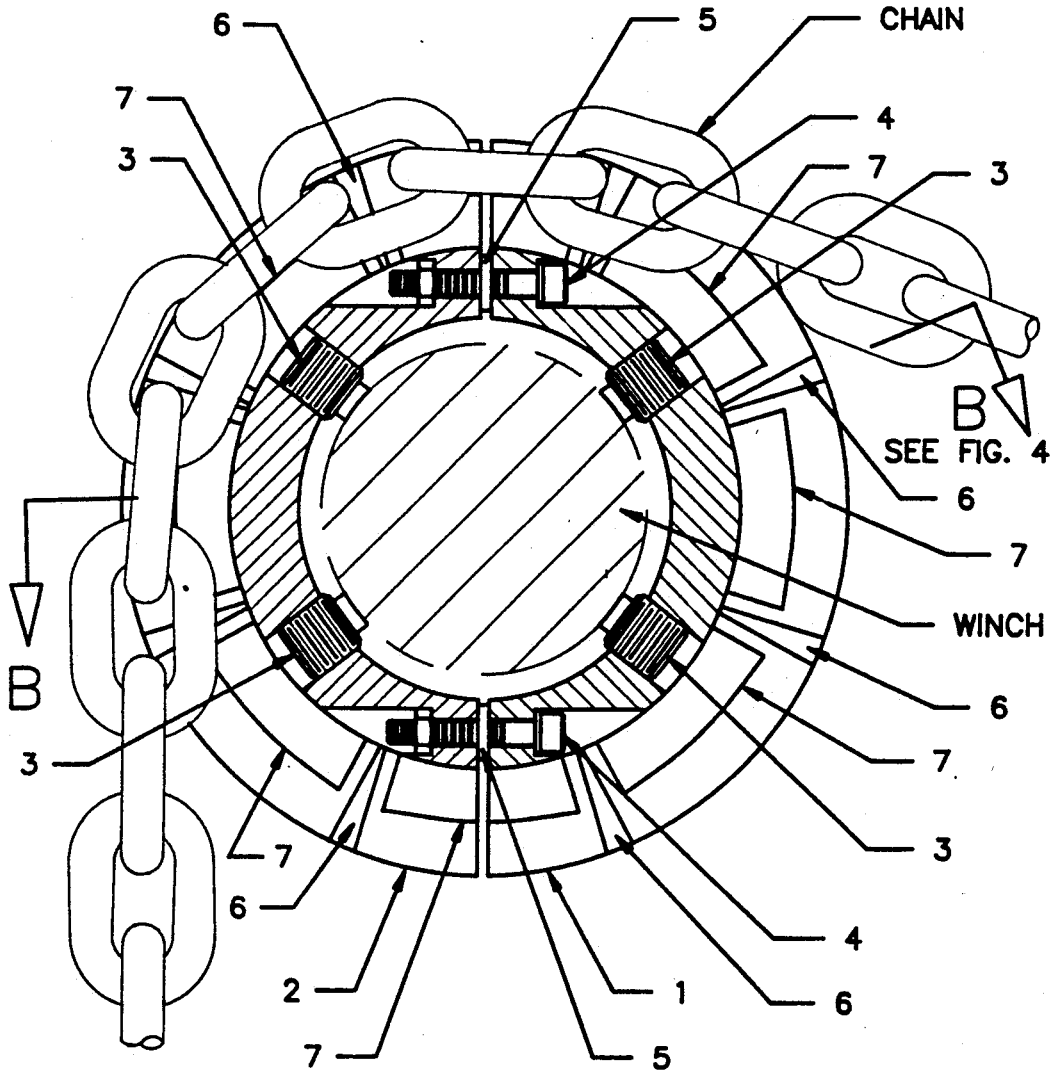
FIG. 2 is a sectional view of the device on the cutting line A—A of FIG. 1
Figure 3:
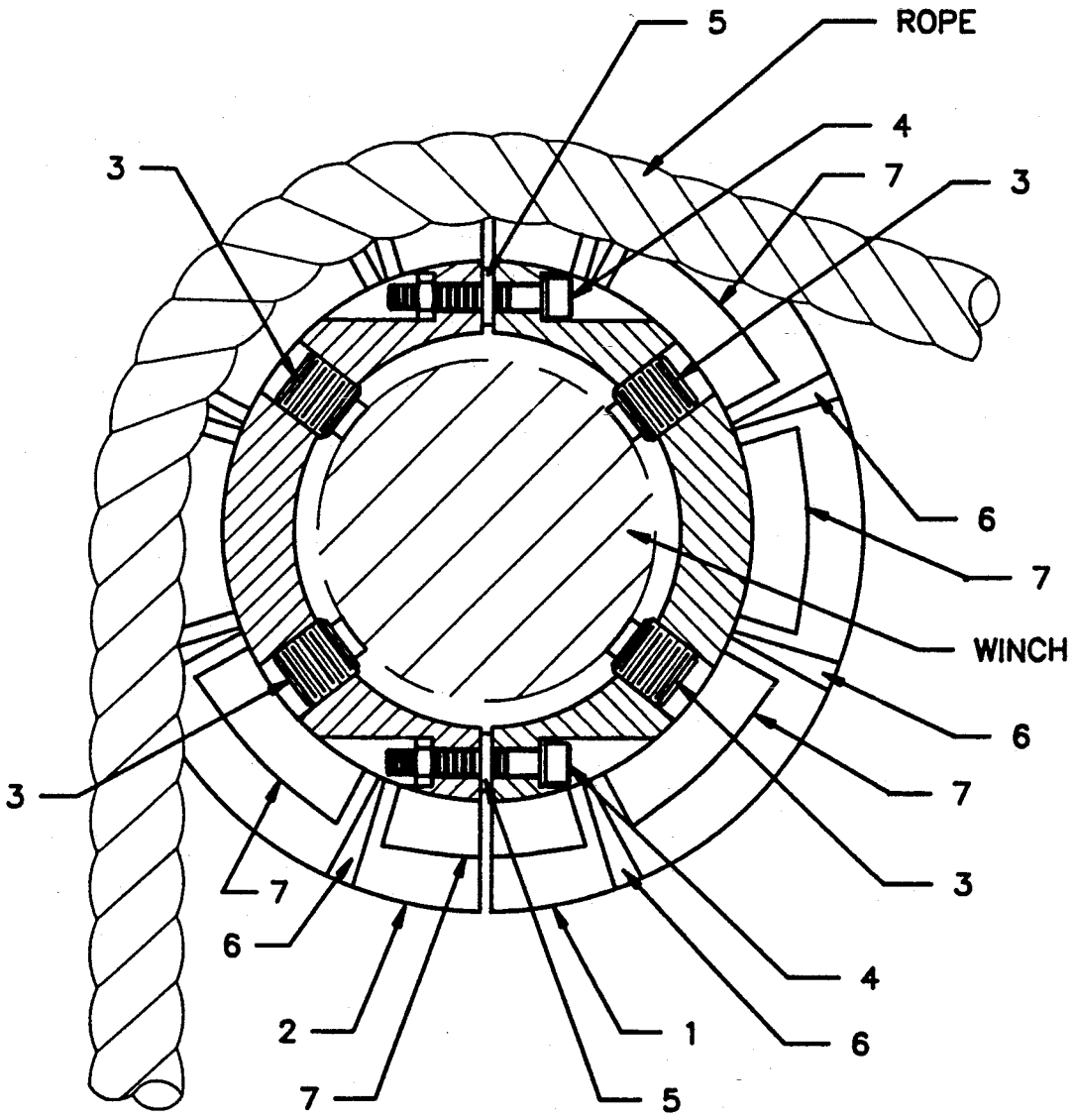
FIG. 3 is a sectional view of the device showing rope and chain positions on the cutting line B—B of FIG. 2
Figure 4:
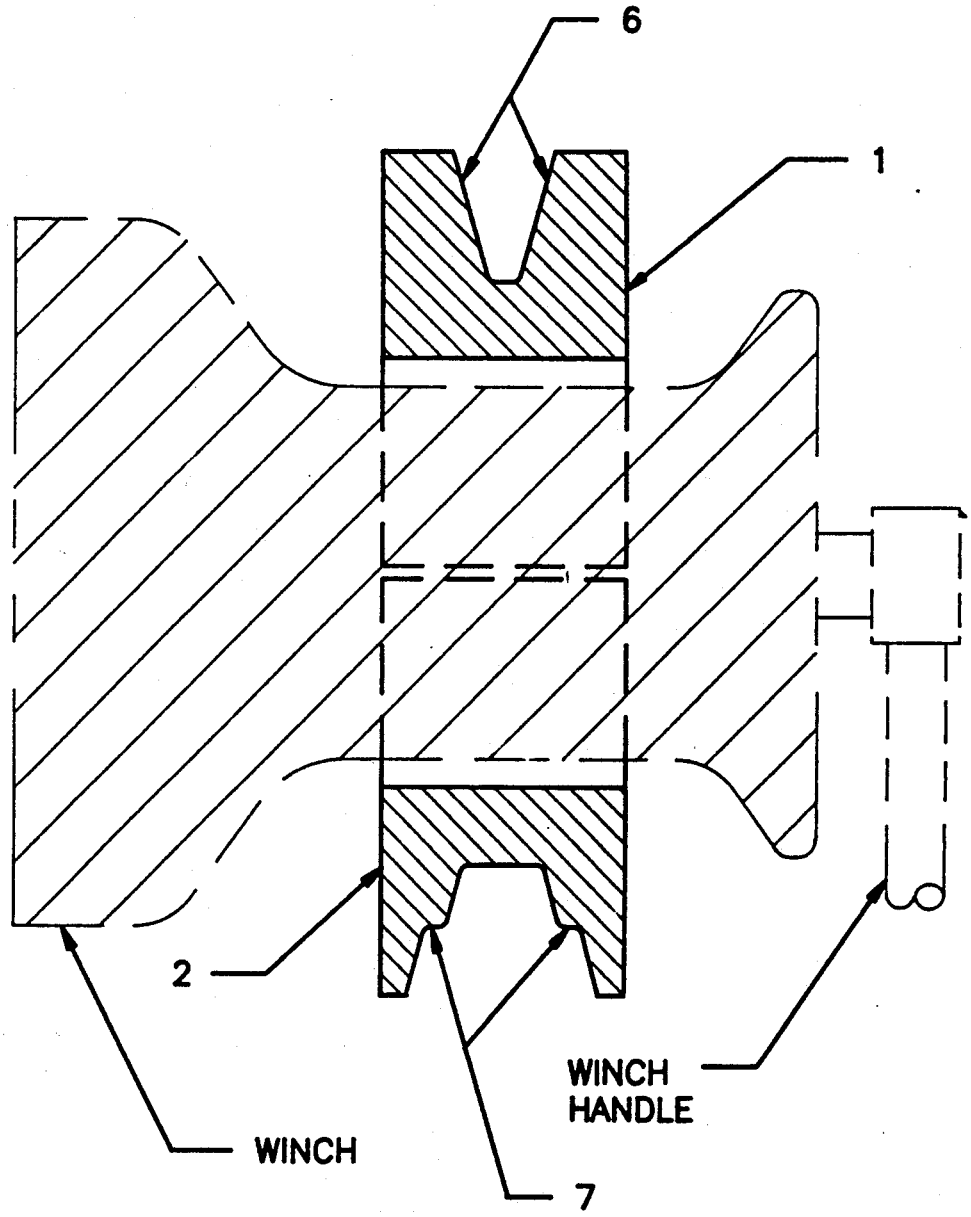
FIG. 4 is a cut away view of FIG. 1

Referring to the drawings, 1 and 2 denotes generally two semi-circle halves of a wheel, one or more friction sizing screws 3 are radially spaced are threadedly engaged to the wheel halves 1 and 2 and which are threadedly adjustable for contact with the drum surface of a drum winch. The friction sizing screws 3 are constructed of a non-galling high coefficient of friction material, a pair of clamping screws 4 which pass through a smooth bore in one half and thread into the opposite half clamp the wheel halves 1 and 2 together around a drum of a driven winch, winch screw retainers 5 keep the clamping screws 4 attached to its associated wheel halve 6 forming a "V" groove in the two wheel halves 1 and 2 the walls form the rope wedge grooves, opposed inwardly projections 7 on the walls form pockets for the chain links.

The wheel halves 1 and 2 each have the rope wedge grooves 6 and chain pockets 7 along with mounting provisions for the friction sizing screws 3, clamping screws 4 and screw retainers 5.

The wheel halves 1 and 2 are clamped around the winch winch diameter of the drum of the using the clamping screws 4. The friction sizing screws 3 are adjustable to fit the two wheel halves to different size winch drum diameters when mounted thereon.

The friction sizing screws 3 come in contact with the winch drum surface. The friction sizing screws 3 being threadedly forced against the winch drum by the clamping screws 4 prevents the wheel halves 1 and 2 from slipping on the winch drum when in use.

What is claimed is:

1. A clamp on combination rope and chain hauler wheel for attachment to the drum of a driven drum winch comprising:

a pair of semi-circular wheel halves having an outer generally convex surface and an inner concave surface with inwardly projecting rectilinear surfaces extending from said outer generally convex surface to a bottom surface with semi-circular openings centrally positioned thereon;

means for removably connecting the two wheel halves together with said inwardly projecting rectilinear surfaces mated for gripping said rope therebetween and said semi-circular openings mating with each other forming a circular opening for receiving and holding links of said chain therein surrounding said drum, said inwardly projecting rectilinear surfaces being positioned only between said circular openings; and adjustable means carried by each hauler wheel half and extending into and beyond the surface of the semi-circular openings for gripping drums of different diameters so that the wheel can be centered on and can grip drums of various diameters thereby preventing relative rotation therebetween when the halves are mated around the drum and the drum is rotated.

2. The invention as defined in claim 1 wherein said means for connecting the two wheels together comprises clamping screws that pass through one of said halves and threadedly engages the other.

3. The invention as defined in claim 2 additionally comprises retainer means for attaching said screws when disengaged to their associated halves.

4. The invention as defined in claim 1 wherein said adjustable means comprises at least one threaded bore through each of said halves and extending from said bottom surface to said inner concave surface of said semi-circular wheel halves and screws threadedly engaging said threaded bore and length adjustable beyond said inner concave surface whereby when the halves are assembled around a drum of a driven winch the screws can be extended toward and engage the drum thereby centering the connected together halves around the drum and preventing relative rotation between the drum and the hauler wheel.

5. The invention as defined in claim 4 wherein one of said halves has at least one bore and screw and the other of said halves has at least two spaced apart bores with screws therein.

6. The invention as defined in claim 1 wherein said means around the periphery of said hauler wheel for griping the links of a chain comprise chain link pockets around the periphery of each half.

7. The invention as defined in claim 1 wherein said inwardly projecting rectilinear surfaces are "V" shaped surfaces which wedge the rope within the "V".

8. The invention as defined in claim 1 wherein the means around the periphery for hauling either chain or rope comprise a plurality of chain link pockets around the outer periphery of the halves and a "V" shaped wall surface positioned between said pockets and said semi-circular openings.

* * * * *